US009999898B2

(12) United States Patent
Kato et al.

(10) Patent No.: US 9,999,898 B2
(45) Date of Patent: Jun. 19, 2018

(54) APPLICATOR AND APPLICATION METHOD

(71) Applicant: FUJIFILM Corporation, Tokyo (JP)

(72) Inventors: Akifumi Kato, Fujinomiya (JP); Takanori Sato, Fujinomiya (JP); Manabu Hashigaya, Fujinomiya (JP); Takahiro Sakamoto, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 0 days. days.

(21) Appl. No.: 15/060,001

(22) Filed: Mar. 3, 2016

(65) Prior Publication Data

US 2016/0175879 A1 Jun. 23, 2016

Related U.S. Application Data

(63) Continuation of application No. PCT/JP2014/068390, filed on Jul. 10, 2014.

(30) Foreign Application Priority Data

Sep. 10, 2013 (JP) ..... 2013-187003
May 20, 2014 (JP) ..... 2014-104318

(51) Int. Cl.
*B05C 17/02* (2006.01)
*D21H 25/12* (2006.01)
(Continued)

(52) U.S. Cl.
CPC ..... *B05C 17/02* (2013.01); *B05C 3/18* (2013.01); *B05C 11/025* (2013.01); *D21H 25/12* (2013.01)

(58) Field of Classification Search
CPC ..... B05C 17/02; B05C 11/025; B05C 3/18; D21H 25/12; D21H 25/20
(Continued)

(56) References Cited

U.S. PATENT DOCUMENTS 3,024,948 A * 3/1962 Rabl ..... B29C 67/205 118/119
7,048,969 B2 5/2006 Ichikawa et al.
(Continued)

FOREIGN PATENT DOCUMENTS

CN 1543377 A 11/2004
JP S58-166872 U 11/1983
(Continued)

OTHER PUBLICATIONS

The extended European search report issued by the European Patent Office dated Aug. 30, 2016, which corresponds to European Patent Application No. 14844052.2-1760 and is related to U.S. Appl. No. 15/060,001.
(Continued)

*Primary Examiner* — Laura E Edwards
(74) *Attorney, Agent, or Firm* — Studebaker & Brackett PC

(57) ABSTRACT

There is provided an applicator that applies a coating liquid onto the upper surface of a web, and an application method which are capable of sufficiently enhancing the evenness of a coating surface. The applicator includes: a bar which rotates while coming into contact with the upper surface of the continuously travelling web via the coating liquid; and a barrier plate which is provided on an upstream side of the bar in a travelling direction of the web and allows the coating liquid to flow in a direction toward the web between the barrier plate and the bar, in which, when a distance between the barrier plate and an end edge portion of the bar, which is closest to the barrier plate, is referred to as A and a distance between the barrier plate and the web is referred to as B, A is 0.5 mm to 5 mm, B is 0.5 mm to 5 mm, and B≤A is satisfied.

6 Claims, 4 Drawing Sheets

(51) Int. Cl.
*B05C 3/18* (2006.01)
*B05C 11/02* (2006.01)

(58) Field of Classification Search
USPC ..... 118/414
See application file for complete search history.

(56) References Cited

U.S. PATENT DOCUMENTS

| | | | | |
|---|---|---|---|---|
| 7,101,438 | B2 * | 9/2006 | Suzuki | B05C 3/18 118/106 |
| 2004/0043154 | A1 | 3/2004 | Ichikawa et al. | |
| 2004/0211361 | A1 | 10/2004 | Suzuki et al. | |

FOREIGN PATENT DOCUMENTS

| | | | |
|---|---|---|---|
| JP | S62-023579 | Y | 6/1987 |
| JP | S62-23579 | Y2 | 6/1987 |
| JP | H1-091162 | U | 6/1989 |
| JP | H5-177159 | A | 7/1993 |
| JP | 2003-062502 | A | 3/2003 |
| JP | 2003-159560 | A | 6/2003 |
| JP | 2009-202132 | A | 9/2009 |
| JP | 2009-240995 | A | 10/2009 |
| KR | 10-2004-0039308 | A | 5/2004 |

OTHER PUBLICATIONS

International Search Report of PCT/JP2014/068390 dated Aug. 19, 2014.
Written Opinion of PCT/JP2014/068390 dated Aug. 19, 2014.
International Preliminary Report of PCT/JP2014/068390 dated Mar. 24, 2016.
An Office Action issued by the Chinese Patent Office dated Feb. 3, 2017, which corresponds to Chinese Patent Application No. 201480049803.4 and is related to U.S. Appl. No. 15/060,001 with English Translation; 14pp.
The Second Office Action issued by the Chinese Patent Office dated Sep. 8, 2017, which corresponds to Chinese Patent Application No. 201480049803.4 and is related to U.S. Appl. No. 15/060,001, with English translation, 13 pp.
An Office Action, "Notification of Reason for Refusal", issued by the Korean Intellectual Property Office dated Sep. 11, 2017, which corresponds to Korean Patent Application No. 10-2016-7005779 and is related to U.S. Appl. No. 15/060,001, with English translation, 7 pp.
An Office Action issued by the Taiwanese Patent Office dated Sep. 25, 2017, which corresponds to Taiwanese Patent Application No. 103128532 and is related to U.S. Appl. No. 15/060,001, with English language Excerption.
An Office Action, "Notice of Final Rejection", issued by the Korean Intellectual Property Office dated Nov. 16, 2017, which corresponds to Korean Patent Application No. 10-2016-7005779 and is related to U.S. Appl. No. 15/060,001, with English translation.

* cited by examiner

APPLICATOR AND APPLICATION METHOD

CROSS-REFERENCE TO RELATED APPLICATIONS

This application is a Continuation of PCT International Application No. PCT/JP2014/068390, filed on Jul. 10, 2014, which claims priority under 35 U.S.C. Section 119(a) to Japanese Patent Application No. 2013-187003 filed on Sep. 10, 2013 and Japanese Patent Application No. 2014-104318 filed on May 20, 2014. Each of the above applications is hereby expressly incorporated by reference, in its entirety, into the present application.

BACKGROUND OF THE INVENTION

1. Field of the Invention

The present invention relates to an applicator and an application method. Specifically, the present invention relates to an applicator which applies a coating liquid onto an upper surface of a continuously traveling web, and an application method using the applicator.

2. Description of the Related Art

Hitherto, in a case where a functional layer such as an easy adhesion layer or an antistatic layer is formed on the surface of a web, a coating liquid is applied onto the surface of the web to form a coating film. As a method of applying the coating liquid to the web surface, a number of application methods including a roll application method, a die application method, a spray application method, a bar application method, and the like are known. Among the methods, the bar application method has been widely used in a case of thinly and evenly applying a low-viscosity coating liquid.

In the case where the coating liquid is applied by the bar application method, a bar, a barrier plate, and the like are provided on the lower surface side of a continuously traveling web, and the coating liquid is applied onto the lower surface of the web while the coating liquid overflows. In the case of applying the coating liquid onto the lower surface of the web, various measures are considered to allow the coating liquid to have an even and desired film thickness.

However, in the case of applying the coating liquid onto the lower surface of the web, in order to prevent the generation of coating unevenness, the coating liquid needs to overflow. Therefore, a complex mechanism for circulating the overflowing coating liquid is necessary. In addition, in the case of coating the lower surface, since the coating liquid is circulated, foreign matter such as lumps in the coating liquid is likely to be generated, and there is a problem of the incorporation thereof into the coating liquid. In the case where foreign matter is incorporated into the coating liquid, the foreign matter may infiltrate into the coating surface, and thus there is a risk of damage to the evenness of the coating surface.

In order to solve the problems regarding the coating of the lower surface, a method of applying a coating liquid onto the upper surface side of a web by the bar application method has been examined. For example, JP2009-202132A and JP1993-177159A (JP-H05-177159A) disclose a method of applying a coating liquid onto the upper surface of a web using a bar coater. In JP2009-202132A, an applicator which has a bar and a barrier plate on the upper surface of a web and has various support rolls is disclosed. In addition, in JP1993-177159A (JP-H05-177159A), an applicator having a bar and a barrier plate (guide plate) on the upper surface of a web is disclosed. In the documents, the coating liquid is applied by forming a liquid mass of the coating liquid on the upper surface of the web.

JP2009-240995A is an example of the related art.

SUMMARY OF THE INVENTION

As described above, in JP2009-202132A and JP1993-177159A (JP-H05-177159A), it is suggested that the coating liquid is applied onto the upper surface of the web by forming the liquid mass of the coating liquid on the upper surface of the web.

However, in the case of applying the coating liquid onto the upper surface of the web, when the liquid mass of the coating liquid is formed as disclosed in JP2009-202132A and JP1993-177159A (JP-H05-177159A), it was apparent from the examination of the present inventors that the evenness of the coating surface is insufficient and unevenness is generated on the surface of the coating surface. In addition, it was apparent from the examination of the present inventors that the coating unevenness is caused by irregular spreading of the liquid mass of the coating liquid toward the upstream side of the barrier plate.

Therefore, in order to solve the problems of the related art, the present inventors conducted examinations for the purpose of providing an applicator which applies a coating liquid onto the upper surface of a web and is capable of sufficiently enhancing the evenness of the coating surface.

As a result of intensive examinations to solve the problems, the present inventors found that, in an applicator which includes a bar that rotates while coming into contact with the upper surface of a continuously traveling web via a coating liquid, and a barrier plate provided on the upstream side of the bar, by allowing the distance between the barrier plate and the bar and the distance between the barrier plate and the web to satisfy predetermined conditions, the evenness of a coating surface can be enhanced.

Specifically, the present invention has the following configurations.

[1] An applicator including: a bar which rotates while coming into contact with an upper surface of a continuously travelling web via a coating liquid; and a barrier plate which is provided on an upstream side of the bar in a travelling direction of the web and allows the coating liquid to flow in a direction toward the web between the barrier plate and the bar, in which, when a distance between the barrier plate and an end edge portion of the bar, which is closest to the barrier plate, is referred to as A and a distance between the barrier plate and the web is referred to as B, A is 0.5 mm to 5 mm, B is 0.5 mm to 5 mm, and B≤A is satisfied.

[2] The applicator described in [1], in which a thickness of an end portion of the barrier plate on the web side is 0.5 mm or greater.

[3] The applicator described in [1] or [2], in which the barrier plate includes a protrusion on the web side.

[4] The applicator described in any one of [1] to [3], in which the barrier plate is of a movable type.

[5] An application method including: supplying a coating liquid between a bar, which rotates while coming into contact with an upper surface of a continuously travelling web via the coating liquid, and a barrier plate, which is provided on an upstream side of the bar in a travelling direction of the web; and applying the coating liquid onto the web, in which, when a distance between the barrier plate and an end edge portion of the bar, which is closest to the barrier plate, is referred to as A and a distance between the barrier plate and the web is referred to as B, A is 0.5 mm to 5 mm, B is 0.5 min to 5 mm, and B≤A is satisfied.

[6] The application method described in [5], in which a liquid mass of the coating liquid is formed on the upper surface of the web, and the liquid mass does not spread toward an upstream side of a side portion of the barrier plate which comes into contact with the coating liquid.

[7] The application method described in [5] or [6], in which a thickness of an end portion of the barrier plate on the web side is 0.5 mm or greater.

[8] The application method described in any one of [5] to [7], in which the barrier plate includes a protrusion on the web side.

[9] The application method described in any one of [5] to [8], in which a viscosity of the coating liquid is 0.5 mPa·s to 100 mPa·s.

[10] The application method described in any one of [5] to [9], in which a travelling speed of the web is 10 m/min to 200 m/min.

[11] The application method described in any one of [5] to [10], in which application is performed to allow a coating amount of the coating liquid applied onto the web to be 2 $ml/m^2$ to 50 $ml/m^2$.

According to the present invention, the applicator which applies the coating liquid onto the upper surface of the web and is capable of sufficiently enhancing the evenness of the coating surface can be obtained. In addition, using the applicator of the present invention, the application method of evenly applying the coating liquid onto the upper surface of the web can be provided.

DESCRIPTION OF THE PREFERRED EMBODIMENTS

Hereinafter, the present invention will be described in detail. The description of the requirements of configurations described below is based on representative embodiments and specific examples, but the present invention is not limited to the embodiments. In addition, in the specification, a numerical range expressed by using "to" means a range including numeral values described before and after "to" as the lower limit and the upper limit.

(Applicator)

The present invention relates to an applicator which includes a bar, which rotates while coming into contact with the upper surface of a continuously travelling web via a coating liquid, and a barrier plate, which is provided on the upstream side of the bar in a travelling direction of the web and allows the coating liquid to flow in a direction toward the web between the barrier plate and the bar. In the applicator of the present invention, when the distance between the barrier plate and an end edge portion of the bar, which is closest to the barrier plate, is referred to as A and the distance between the barrier plate and the web is referred to as B, A is 0.5 mm to 5 mm, B is 0.5 mm to 5 mm, and B≤A is satisfied.

Figure 1A:
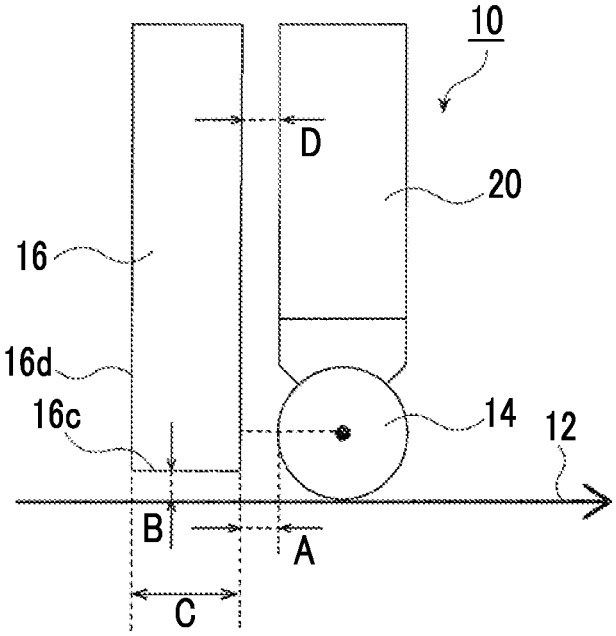
FIGS. 1A and 1B are schematic views illustrating an applicator according to an embodiment of the present invention.
Figure 1B:
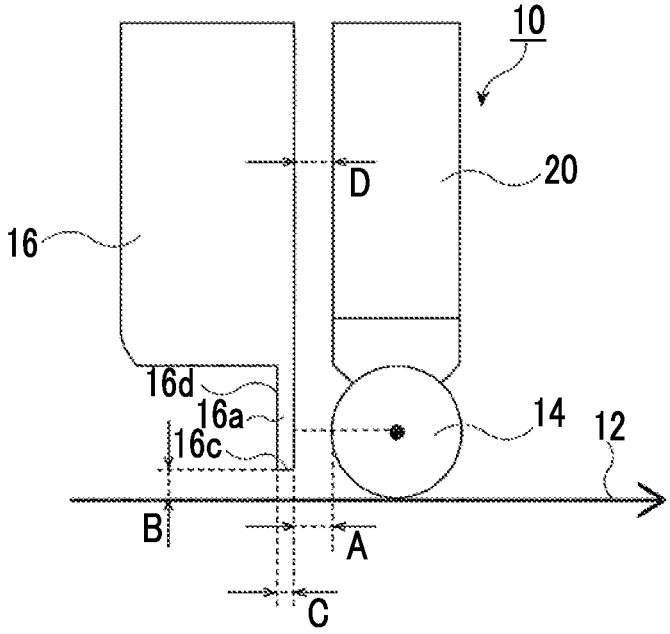

As illustrated in FIGS. 1A and 1B, an applicator 10 includes a bar 14 provided on the upper surface of a web 12, and a barrier plate 16 provided on the upstream side of the bar 14 in a travelling direction of the web 12. As illustrated in FIG. 1A, the barrier plate 16 may have a plate shape or a rectangular parallelepiped shape. In addition, as illustrated in FIG. 1B, the barrier plate 16 may also have a structure including a protrusion 16*a* on the web 12 side.

The distance A between the barrier plate 16 and the end edge portion of the bar 14, which is closest to the barrier plate 16, may be 0.5 mm to 5 mm, is preferably 1 mm to 5 mm, and is more preferably 1 mm to 4.5 mm. By allowing the distance A between the barrier plate 16 and the end edge portion of the bar 14 to be in the above range, the distance between the barrier plate 16 and the bar 14 can be an appropriate distance, resulting in a smooth flow of the coating liquid. In addition, it becomes possible to supply an appropriate amount of the coating liquid onto the web 12.

The distance B between the barrier plate 16 and the web 12 may be 0.5 mm to 5 mm, is preferably 0.5 mm to 4 mm, and is more preferably 1 mm to 3 mm. By allowing the distance between the barrier plate 16 and the web 12 to be in the above range, the spreading of a liquid mass of the coating liquid formed on the web 12 toward the upstream side of the barrier plate 16 can be suppressed. Accordingly, it becomes possible to form the liquid mass having any desired shape, which will be described later, on the web 12.

The distance A between the barrier plate 16 and the end edge portion of the bar 14, which is closest to the barrier plate 16, and the distance B between the barrier plate 16 and the web 12 have a relationship of B≤A. With respect to A, B is preferably 90% or less, more preferably 80% or less, and even more preferably 70% or less. By allowing the relationship between B and A to satisfy the above condition, the shape of the liquid mass of the coating liquid formed on the web 12 can be a desired shape. Accordingly, the evenness of the coating surface can be sufficiently enhanced.

In FIGS. 1A and 1B, the thickness of the end portion of the barrier plate 16 on the web side is denoted by C. Here, C is preferably 0.5 mm or greater, more preferably 0.8 mm or greater, and even more preferably 1 mm or greater. In addition, C is preferably 10 mm or smaller, more preferably 8 mm or smaller, and even more preferably 5 mm or smaller. By allowing the thickness C of the end portion of the bather plate 16 on the web side to be in the above range, the liquid mass formed on the web 12 can be linked to the end portion of the barrier plate on the web side. Therefore, the spreading of the liquid mass to a side portion on the upstream side connected to the web side end portion of the barrier plate 16 can be suppressed. Accordingly, the evenness of the coating surface can be more effectively enhanced.

Here, the end portion of the barrier plate 16 on the web side is referred to as a lower edge end (lower side) of the barrier plate, which is present closest to the web side. In FIGS. 1A and 1B, the web side end portion is a side denoted by 16*c*, and the side portion on the upstream side connected to the web side end portion is a side denoted by 16*d*.

As illustrated in FIGS. 1A and 1B, the bar 14 is supported by a support member 20. The support member 20 may have a structure that rotatably supports the bar 14.

The distance D between the support member 20 and the barrier plate 16 is preferably 0.1 mm to 20 mm, more preferably 0.1 mm to 15 mm, and even more preferably 0.1 mm to 10 mm. By allowing the distance D between the support member 20 and the barrier plate 16 to be in the above range, a coating speed at which the coating liquid is applied onto the web can be easily adjusted. Accordingly, the coating liquid even having a low viscosity can be evenly applied.

In addition, the distance D between the support member 20 and the barrier plate 16 indicates the shortest distance between the support member 20 and the barrier plate 16, and the side portion of the support member 20 on a side that comes into contact with the coating liquid and the side portion of the barrier plate 16 on a side that comes into contact with the coating liquid do not necessarily need to be always parallel to each other.

Figure 2A:
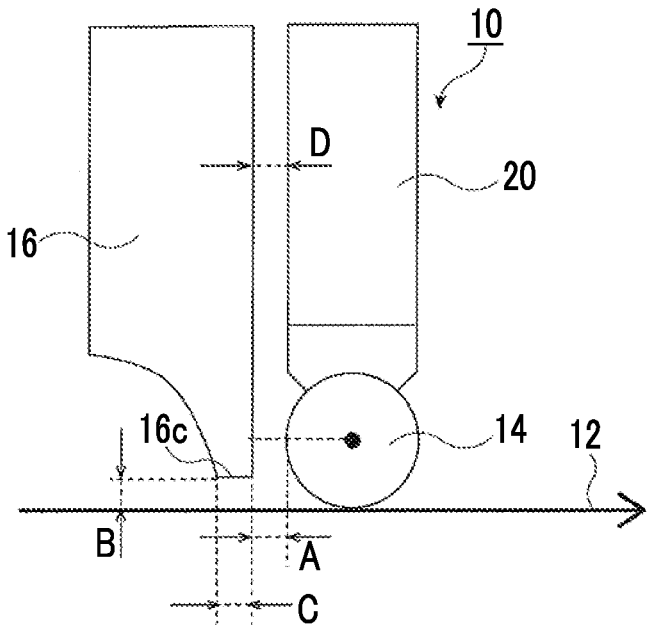
FIGS. 2A and 2B are schematic views illustrating an applicator according to another embodiment of the present invention.
Figure 2B:
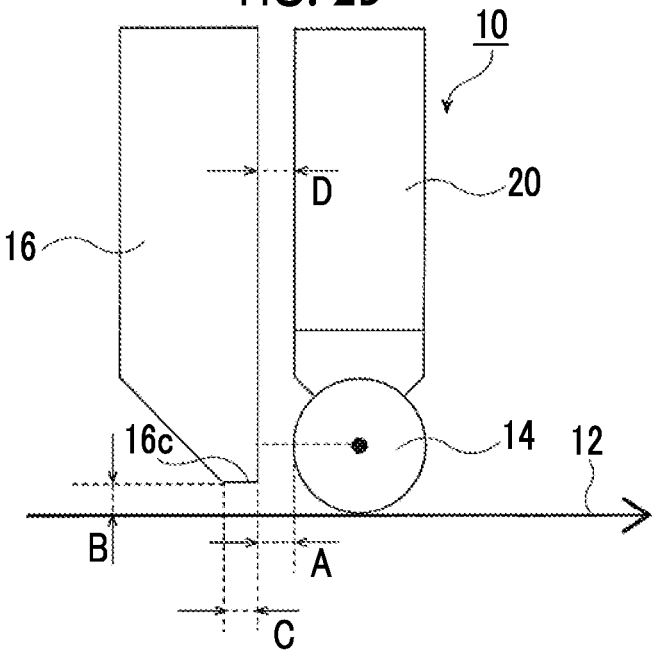

The shape of the barrier plate 16 may also be a shape having a protrusion as illustrated in FIGS. 2A and 2B. Here, the protrusion is referred to as a portion in which the thickness of the barrier plate is reduced toward the web, and a portion having a smaller thickness than the average of the thicknesses of the barrier plate. That is, the shape of the barrier plate 16 may also be a shape tapered toward the web. Even when the barrier plate 16 has the shape as illustrated in FIGS. 2A and 2B, the shape of the liquid mass of the coating liquid can be a desired shape, and thus the coating liquid can be evenly applied onto the upper surface of the web. Furthermore, even when the barrier plate 16 has the shape as illustrated in FIGS. 2A and 2B, the barrier plate 16 can be easily processed, and the strength of the protrusion of the barrier plate can be increased.

Figure 3:
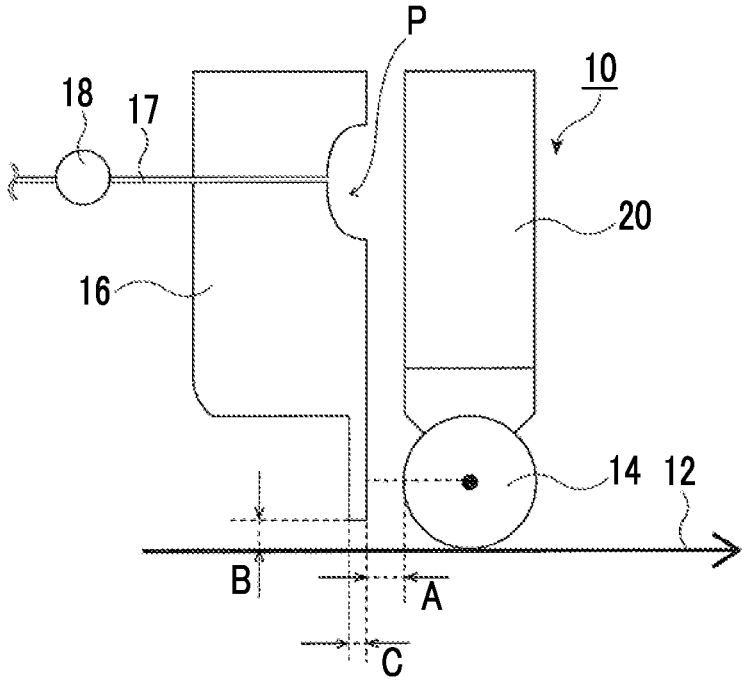
FIG. 3 is a schematic view illustrating an applicator according to another embodiment of the present invention.

As illustrated in FIG. 3, the barrier plate 16 of the applicator 10 may have a feed liquid storage portion P. The feed liquid storage portion P has a function of temporarily storing the supplied coating liquid. The coating liquid is supplied to the feed liquid storage portion P through a supply tube 17. The supply tube 17 is connected to a pump 18, and the pump 18 is connected to a storage tank (not illustrated) of the coating liquid. The coating liquid is supplied to the feed liquid storage portion P by driving the pump 18. By providing the feed liquid storage portion P in the barrier plate 16, the coating liquid can be temporarily stored, and a change in the flow rate of the coating liquid supplied from a supply tube 17 can be suppressed when the discharge amount of the pump 18 is changed.

Figure 4A:
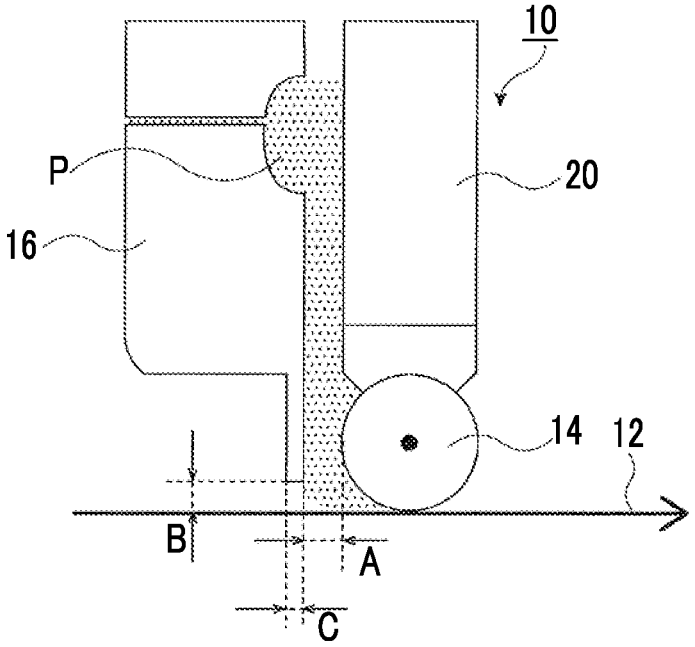
FIGS. 4A to 4C are schematic views illustrating a form in which a coating liquid flows in the applicator of the present invention.
Figure 4B:
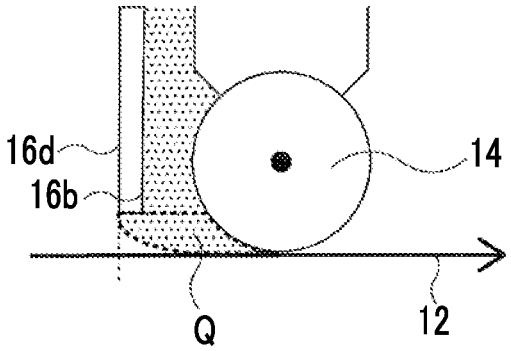
Figure 4C:
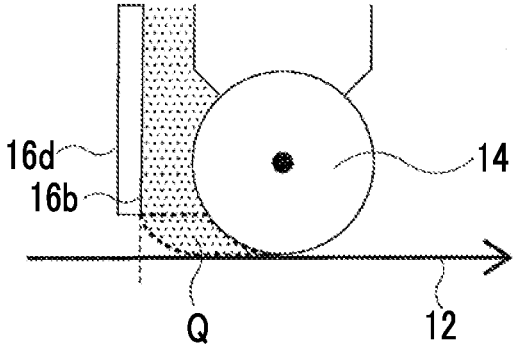

FIG. 4A illustrates a form in which the coating liquid flows in the applicator 10 of the present invention. As illustrated in FIGS. 4A to 4C, the coating liquid supplied to the feed liquid storage portion P flows downward from the upper side between the barrier plate 16 and the support member 20, and further flows downward from the upper side between the barrier plate 16 and the bar 14. Thereafter, the coating liquid is discharged toward the upper surface of the web 12.

The coating liquid discharged toward the web 12 forms a liquid mass Q in a space surrounded by the upper surface of the web 12, the bar 14, and a corner portion or the web side end portion of the barrier plate 16. The liquid mass Q is a region formed below the lower side of the end portion of the barrier plate 16 on the web side, and is referred to as a region of the coating liquid that is present between the bar 14 and the web 12. Application is performed as the coating liquid in the liquid mass Q adheres to the surface of the web 12. In addition, as illustrated in FIGS. 4B and 4C, the liquid mass Q is referred to as a region surrounded by thick dotted lines.

As illustrated in FIG. 4B, it is preferable that the side end portion of the liquid mass Q, which is a side end portion positioned on the opposite side of the bar 14, does not spread toward the upstream side of the side portion on the upstream side connected to the web side end portion of the barrier plate 16. Moreover, as illustrated in FIG. 4C, it is more preferable that the side end portion of the liquid mass Q does not spread toward the upstream side of a side portion (side portion on the downstream side connected to the web side end portion) 16*b* of the barrier plate, which comes into contact with the coating liquid. In addition, FIG. 4B illustrates a form in which the liquid mass Q is present downstream of the side portion (side portion on the upstream side connected to the web side end portion) 16*d* of the barrier plate, which comes into contact with the coating liquid. FIG. 4C illustrates a form in which the liquid mass Q is present downstream of the side portion (side portion on the downstream side connected to the web side end portion) 16*b* of the barrier plate, which comes into contact with the coating liquid. As described above, by controlling the spreading of the liquid mass Q, the evenness of the coating surface can be increased, and coating defects, processing contamination, and the like can be suppressed. Here, the upstream side of the side portion is referred to as a region upstream of the end point of the side portion, which is closest to the web side, and the downstream side thereof is referred to as a region downstream of the end point of the side portion, which is closest to the web side.

A state in which the liquid mass Q does not spread toward the upstream side of the side portion of the barrier plate, which comes into contact with the coating liquid, preferably indicates the state illustrated in FIG. 4C, but also includes a state in which the liquid mass Q does not spread toward the upstream side of the side portion on the upstream side as illustrated in FIG. 4B. That is, the state in which the liquid mass Q does not spread toward the upstream side of the side portion of the barrier plate, which comes into contact with the coating liquid, preferably indicates the state in which the liquid mass is present downstream of the side portion on the downstream side connected to the web side end portion, and may also include the state in which the liquid mass Q is present downstream of the side portion on the upstream side.

The shape of the liquid mass Q can be changed by adjusting the shape or the thickness C of the end portion of the barrier plate 16 on the web side. Particularly, by allowing the thickness C to be in a predetermined range, the spreading of the coating liquid toward the upstream side of the barrier plate can be suppressed. Accordingly, it becomes possible to enable the spreading of the coating liquid to be confined to the downstream side of the side portion (side portion on the downstream side connected to the web side end portion) 16*b* of the barrier plate.

In the applicator of the present invention, the barrier plate is preferably of a movable type. Here, the movable type means that the barrier plate is movable in any of upward and downward directions and leftward and rightward directions. That is, the barrier plate preferably has movable means, and as the movable means, well-known means can be used without particular limitations.

It is preferable that the movable means moves the barrier plate in at least one of the up and down directions and the left and right directions so as not to allow the liquid mass to spread toward the upstream side of the end portion of the barrier plate on the web side. Specifically, it is preferable that the movable means is able to control the distance A between the barrier plate and the end edge portion of the bar, which is closest to the barrier plate, and the distance B between the barrier plate and the web, and control the liquid mass of the coating liquid so as not to spread toward the upstream of the side portion on the upstream side connected to the web side end portion, and it is preferable that the movable means is able to control the liquid mass so as not to spread toward the upstream of the side portion on the downstream side connected to the web side end portion.

In addition, the movable means may receive feedback on information regarding the shape of the liquid mass, automatically calculate the distance A between the barrier plate and the end edge portion of the bar, which is closest to the barrier plate, and the distance B between the barrier plate and the web, and move the barrier plate to achieve preferable distances. Furthermore, the movable means may have a system which calculates the distance A between the barrier plate and the end edge portion of the bar, which is closest to the barrier plate, and the distance B between the barrier plate and the web according to information regarding the properties of the coating liquid and the like.

(Bar)

The bar is formed in a columnar shape and is rotatably supported by the support member. The bar rotates about its axis while coming into contact with the upper surface of the travelling web via the coating liquid. The rotational direction of the bar may be the same direction as the travelling direction of the web, or may be the opposite direction thereto.

The surface of the bar may be smoothly finished, and may also be provided with grooves at predetermined intervals in a circumferential direction thereof, or wires densely wound thereon. The diameter of the wire wound on the bar is preferably 0.05 mm to 0.5 mm, and particularly preferably 0.05 mm to 0.2 mm. In addition, regarding the bar provided with the grooves or the bar on which the wires are wound, the coating liquid can be thinly applied by reducing the depth of the grooves or the thickness of the wires, and the coating liquid can be thickly applied by increasing the depth of the grooves or the thickness of the wires.

The diameter of the bar is preferably 6 mm to 25 mm, and more preferably 6 mm to 20 mm. By allowing the diameter of the bar to be in the above range, the generation of vertical stripes on the coating surface of the coating liquid can be suppressed.

The width of the bar may have the same size as the width of the web, and is preferably greater than the width of the web. In addition, in the case where the bar is provided with the grooves or the wires, a range in which the grooves or the wires are provided is preferably greater than the width of the web.

The material of the bar is preferably stainless steel, and is particularly preferably SUS304 or SUS316. A surface treatment such as hard chrome plating or diamond-like carbon (DLC) plating may also be performed on the surface of the bar.

The support member of the bar has a structure that rotatably supports the bar. In addition, the support member of the bar may have arc-shaped grooves on the surface that comes into contact with the bar. By forming the arc-shaped grooves, bending of the bar due to the tension of the web is suppressed, and thus a uniform coating film can be formed in the thickness direction.

A side of the support member, which comes into contact with the bar, and the other side of the support member, which does not come into contact with the bar, may be formed of different materials. For example, in a case where the bar is made of metal such as stainless steel, the side of the support member, which comes into contact with the bar, is preferably formed by using a polymer resin or the like, and the other side of the support member, which does not come into contact with the bar, is preferably made of metal such as stainless steel. In addition, the surface thereof which comes into contact with the bar is preferably provided with arc-shaped grooves.

The size of the support member can be appropriately adjusted according to the size of the bar. For example, the thickness of the support member is equal to or greater than the radius of the bar, and is preferably equal to or smaller than twice the diameter of the bar. In addition, the height of the support member is preferably 10 mm to 100 mm. Furthermore, the width of the support member is preferably equal to or greater than the width of the wire or the groove provided in the bar.

(Barrier Plate)

The barrier plate is a member provided above the upper surface of the web, and the end portion thereof on the web side is fixed so as not to come into contact with the web. The barrier plate may have a plate shape or a rectangular parallelepiped shape, and may also have a structure including a protrusion on the web side. The protrusion is referred to as a portion protruding from the body of the barrier plate.

It is preferable that the thickness of the end portion of the barrier plate is a thickness having a predetermined value or lower. However, when the entirety of the barrier plate is thin, the rigidity of the barrier plate itself is insufficient. Therefore, by providing the protrusion for the barrier plate, it becomes possible to enhance the rigidity of the entirety of the barrier plate while allowing the thickness of the end portion of the barrier plate to have the predetermined value or lower.

The thickness C of the end portion of the barrier plate on the web side is preferably 0.5 mm or greater, more preferably 0.8 mm or greater, and even more preferably 1 mm or greater. In addition, C is preferably 10 mm or smaller, more preferably 8 mm or smaller, and even more preferably 5 mm or smaller.

It is preferable that the end portion of the barrier plate on the web side is parallel to the web. Accordingly, the end portion of the barrier plate can be easily processed, and thus the strength of the end portion can be increased.

Although it is preferable that the end portion of the barrier plate on the web side is parallel to the web, the end portion thereof may also be inclined with respect to the web without damaging the effect of the present invention. In this case, it is preferable that the angle formed between the web and the end portion of the barrier plate on the web side is within ±20°.

The shape of the tip end of the barrier plate can be changed in a range that does not damage the effect of the present invention. For example, the angle between the web side end portion of the barrier plate and the side portion on the upstream side connected to the web side end portion may be adjusted in a range of 30° to 150°. As described above, it is possible to design the structure of the tip end of the barrier plate as necessary.

The thickness of the entirety of the barrier plate is preferably in a range of 0.5 mm to 10 mm in a case of not providing the protrusion, and is preferably in a range of 5 mm to 50 mm in a case of providing the protrusion. In addition, the height of the barrier plate is preferably 10 mm to 100 mm, and the width of the barrier plate is preferably equal to or greater than the width of the wire or the groove provided on the bar.

The material of the barrier plate is not particularly limited, and for example, plastic or metal may be selected. Among these, from the viewpoint of rigidity and precision, stainless steel is more preferable, and SUS304 or SUS316 is particularly preferably used.

(Web)

As the web used in the present invention, paper, plastic film, resin-coated paper, synthetic paper, and the like may be employed. Examples of the material of the plastic film include polyolefin such as polyethylene and polypropylene, a vinyl polymer such as polyvinyl acetate, polyvinyl chloride, and polystyrene, polyamide such as 6,6-nylon and 6-nylon, polyester such as polyethylene terephthalate and polyethylene-2,6-naphthalate, polycarbonate, and cellulose acetate such as cellulose triacetate and cellulose diacetate. A resin used for the resin-coated paper can be exemplified by the polyolefin such as polyethylene and the like as a representative example.

The thickness of the web is not particularly limited, and a web of 0.01 mm to 1.5 mm is preferably used from the viewpoint of handling properties and versatility.

The web comes into contact with the bar via the coating liquid in a state of applying tension thereto. The angle formed between the web and a horizontal plane is preferably 0° to 10° on any of the upstream side and the downstream side of the bar, and is more preferably 0° to 5°. By allowing the angle of the web to be in the above range, the coating surface can be even, and wear of the bar and the like can be suppressed.

(Application Method)

The present invention relates to an application method of supplying the coating liquid between the bar, which rotates while coming into contact with the upper surface of the continuously travelling web via the coating liquid, and the barrier plate, which is provided on the upstream side of the bar in the travelling direction of the web, and applying the coating liquid onto the web. The application method of the present invention is a method of applying the coating liquid onto the upper surface of the web using the above-described applicator. That is, when the distance between the barrier plate and the end edge portion of the bar, which is closest to the barrier plate, is referred to as A and the distance between the barrier plate and the web is referred to as B, A is 0.5 mm to 5 mm, B is 0.5 mm to 5 mm, and B≤A is satisfied.

The coating liquid flows downward from the upper side between the barrier plate and the support member which supports the bar, and further flows downward from the upper side between the barrier plate and the bar. Thereafter, the coating liquid is discharged toward the upper surface of the web. The coating liquid discharged toward the web forms the liquid mass in the space surrounded by the upper surface of the web, the bar, and the corner portion of the barrier plate. Application is performed as the coating liquid in the liquid mass adheres to the surface of the web.

In the application method of the present invention, it is preferable to control the shape of the liquid mass so as not to allow the liquid mass formed on the upper surface of the web to spread from the upstream side of the side portion on the upstream side connected to the web side end portion, and it is preferable to control the shape of the liquid mass so as not to allow the liquid mass to spread from the upstream side of the side portion (the side portion of the barrier plate which comes into contact with the coating liquid) on the downstream side connected to the web side end portion.

Control of the shape of the liquid mass is achieved by allowing the distance A between the barrier plate and the end edge portion of the bar, which is closest to the barrier plate, and the distance B between the barrier plate and the web to be in a specified range and have a relationship of B≤A.

The coating liquid used in the application method of the present invention is not particularly limited, and may be exemplified by water, an organic solvent, a pigment dispersion liquid, a colloidal solution, or the like of a polymer compound. Particularly, a coating liquid for various optical films required to enable uniform and highly precise thin layer coating, for example, a discotic liquid crystalline coating liquid is appropriately used.

The viscosity of the coating liquid is preferably 0.5 mPa·s to 100 mPa·s, more preferably 1 mPa·s to 80 mPa·s, and even more preferably 1 mPa·s to 50 mPa·s. By allowing the viscosity of the coating liquid to be in the above range, the generation of streaky unevenness on the coating surface can be suppressed. The applicator of the present invention can be preferably used for the application of such a low-viscosity coating liquid.

The surface tension of the coating liquid is preferably 20 mN/m to 60 mN/m, and more preferably 25 mN/m to 55 mN/m. By allowing the surface tension of the coating liquid to be in the above range, the generation of streaky unevenness on the coating surface can be suppressed. Furthermore, by allowing the surface tension of the coating liquid to be in the above range, the fluidity of the coating liquid on the web can be enhanced, and thus the coating surface can have an even coating film thickness.

The travelling speed of the web is preferably 10 m/min to 200 m/min, more preferably 15 m/min to 150 m/min, and even more preferably 20 m/min to 120 m/min. In addition, it is preferable that the supply amount of the coating liquid is appropriately adjusted according to the coating amount specified by the travelling speed of the web and the bar.

According to the application method of the present invention, the coating liquid can be applied onto the web to have a coating amount of 2 $ml/m^2$ to 50 $ml/m^2$. The coating amount the coating liquid is more preferably 3 $ml/m^2$ to 40 $ml/m^2$, and even more preferably 3 $ml/m^2$ to 30 $ml/m^2$. In the application method of the present invention, since the coating amount can be in the above range, the generation of streaky unevenness on the coating surface can be suppressed. Furthermore, by allowing the coating amount to be in the above range, drying of the coating liquid easily proceeds. Accordingly, adhesion of the coating liquid to an unintended area is suppressed, and thus contamination or the like in the production process can be suppressed.

In addition, by using the application method of the present invention, it is possible to suppress a rate of change in the film thickness of the coating liquid formed on the web to 10% or less. Here, the rate of change in the film thickness of the coating liquid is expressed as a percentage obtained by measuring the film thicknesses of 20 arbitrary points on a square coating surface of 1 m×1 m and dividing the difference between the maximum value and the minimum value by the average value.

(Uses)

The applicator and the application method according to the present invention are not limited to uses for the production of a lithographic printing plate, and can be used in a case of performing application using a bar, such as production of a photosensitive material such as a photographic film, production of a magnetic recording material such as a recording tape, production of a thin coating metal plate such as a colored steel sheet, and the like. Therefore, as the web, in addition to support webs described in the Description of the Related Art, a lithographic printing plate precursor web in which a photosensitive or thermosensitive platemaking surface is formed on the surface of the support web on a grained side, a base material for a photographic film, baryta paper for photographic printing paper, a base material for a recording tape, a base material for a video tape, a base material for a floppy (registered trademark) disk, a base material which is formed of metal, plastic, or paper and has flexibility in the form of a continuous strip shape, and the like may be employed. In addition, as the coating liquid, a solution which is used to be applied onto the web and dried to form a film may be employed. Specifically, in addition to a photosensitive layer forming liquid and a thermosensitive layer forming liquid, an intermediate layer forming liquid for forming an intermediate layer on the surface of the web and improving adhesion of a platemaking layer, an aqueous solution of polyvinyl alcohol used to form an anodic oxide film for protecting the platemaking surface of a lithographic printing plate precursor web from oxidation, a sensitizing agent colloidal solution for a photographic film used to form a photosensitive layer in the photographic film, a sensitizing agent colloidal solution for photographic printing paper used to form a photosensitive layer of the photographic printing paper, a magnetic layer forming liquid used to form a magnetic layer such as a recording tape, a video tape, and a floppy disk, various types of paints used for metal coating, and the like may be employed.

In addition, by using the applicator and the application method according to the present invention, it becomes possible to efficiently form the coating surface on both surfaces of the web. In the related art, in a case of forming an even coating film, a lower surface applicator has been widely used. In this case, after providing a first lower surface coating process, the transportation direction is changed using a web transportation roll, and a second lower surface coating process needs to be provided again. Therefore, the transport distance until the coating surface is formed on both the surfaces is increased, and thus a wide coating space for the coating liquid is necessary.

However, by using the applicator and the application method according to the present invention, it becomes possible to form an even coating film even during upper surface coating. Therefore, in a case of forming the coating surface on both surfaces of the web, the lower surface coating in the related art and the upper surface coating performed using the applicator of the present invention can be simultaneously performed, and thus the coating space can be reduced. Accordingly, the film production process can be simplified, and it becomes possible to suppress production costs.

EXAMPLES

Hereinafter, the features of the present invention will be described in more detail with reference to Examples and Comparative Examples. However, the scope of the present invention is not construed as being limited by specific examples described below.

Example 1

As the web, a PET film having a thickness of 188 μm and a width of 600 mm was used. The coating liquid was prepared by dissolving a polyester resin, a cross-linking agent, and a surfactant in water. In addition, the amounts of the components of the coating liquid were adjusted to achieve a viscosity of 2 mPa·s. The surface tension of the coating liquid was 40 mN/m.

In Example 1, the coating liquid was applied by using the applicator illustrated in FIG. 3. The distance (A) between the barrier plate 16 and the end edge portion of the bar 14, which is closest to the barrier plate 16, was set to 2 mm, and the distance (B) between the barrier plate 16 and the web 12 was set to 1.5 mm. The relationship between the distance (A) and the distance (B) was set to B≤A. In addition, the thickness (C) of the end portion of the barrier plate 16 was set to 1 mm. The diameter of the bar was set to 10 mm, and the width thereof was set to 800 mm.

The coating liquid was supplied to the feed liquid storage portion P, and the coating liquid was applied onto the upper surface of the web 12. The travelling speed of the web while being coated with the coating liquid was set to 40 m/min. The coating amount the coating liquid was set to 5 ml/m$^2$.

Example 2

The coating liquid was applied in the same manner as in Example 1 except that the thickness of the protrusion of the barrier plate was set to 0.3 mm.

Example 3

The coating liquid was applied in the same manner as in Example 1 except that the distance A was set to 1 mm, and the distance B was set to 1 mm.

Example 4

A coating liquid having a viscosity of 10 mPa·s was obtained by changing the mixing ratios of the components of the coating liquid. The surface tension of the coating liquid was 40 mN/m. The coating liquid was applied in the same manner as in Example 1 except that the coating liquid was used, the distance A was set to 4 mm, the distance B was set to 4 mm, and the travelling speed of the web was set to 60 m/min.

Example 5

The coating liquid was applied in the same manner as in Example 4 except that the distance A was set to 4 mm, and the distance B was set to 1.5 mm.

Example 6

The coating liquid was applied in the same manner as in Example 4 except that the distance A was set to 2 mm, the distance B was set to 1.5 mm, and the thickness of the protrusion of the barrier plate was set to 2 mm.

Example 7

The coating liquid was applied in the same manner as in Example 1 except that the distance A was set to 4 mm, the distance B was set to 1.5 mm, the travelling speed of the web was set to 20 m/min, and the coating amount the coating liquid was set to 3 ml/m$^2$.

Example 8

The coating liquid was applied in the same manner as in Example 7 except that the coating amount the coating liquid was set to 30 ml/m$^2$.

Example 9

The coating liquid was applied in the same manner as in Example 7 except that the travelling speed of the web was set to 100 m/min.

Example 10

The coating liquid was applied in the same manner as in Example 9 except that the coating amount the coating liquid was set to 30 ml/m$^2$.

Comparative Example 1

The coating liquid was applied in the same manner as in Example 1 except that the distance A was set to 6 mm, the distance B was set to 1.5 mm, and the travelling speed of the web was set to 60 m/min.

Comparative Example 2

The coating liquid was applied in the same manner as in Example 4 except that the distance A was set to 7 mm, the distance B was set to 6 mm, and the travelling speed of the web was set to 40 m/min.

Comparative Example 3

The coating liquid was applied in the same manner as in Example 1 except that the distance A was set to 2 mm, and the distance B was set to 3 mm.

(Surface State Evaluation)

Surface state evaluation was performed according to the following criteria by visually observing streaky unevenness generated on the coating surface of the web on the downstream side immediately after bar coating. In addition, an acceptable level that satisfies production quality is B or higher.

A: Streaky unevenness is rarely present.

B: Weak streaky unevenness is present.

C: Strong streaky unevenness is present.

TABLE 1

| | Distance (A) between barrier plate and end edge portion of bar | Distance (B) between barrier plate and web | Relationship between A and B | Thickness (C) of end portion of barrier plate | Viscosity of coating liquid | Travelling direction of web | Coating amount of coating liquid (ml/m$^2$) | Surface state |
|---|---|---|---|---|---|---|---|---|
| Example 1 | 2 | 1.5 | B ≤ A | 1 | 2 | 40 | 5 | A |
| Example 2 | 2 | 1.5 | B ≤ A | 0.3 | 2 | 40 | 5 | B |
| Example 3 | 1 | 1 | B ≤ A | 1 | 2 | 40 | 5 | A |
| Example 4 | 4 | 4 | B ≤ A | 1 | 10 | 60 | 5 | B |
| Example 5 | 4 | 1.5 | B ≤ A | 1 | 10 | 60 | 5 | A |
| Example 6 | 2 | 1.5 | B ≤ A | 2 | 10 | 60 | 5 | A |
| Example 7 | 4 | 1.5 | B ≤ A | 1 | 2 | 20 | 3 | A |
| Example 8 | 4 | 1.5 | B ≤ A | 1 | 2 | 20 | 30 | A |
| Example 9 | 4 | 1.5 | B ≤ A | 1 | 2 | 100 | 3 | A |
| Example 10 | 4 | 1.5 | B ≤ A | 1 | 2 | 100 | 30 | A |
| Comparative Example 1 | 6 | 1.5 | B ≤ A | 1 | 2 | 60 | 5 | C |
| Comparative Example 2 | 7 | 6 | B ≤ A | 1 | 10 | 40 | 5 | C |
| Comparative Example 3 | 2 | 3 | B > A | 1 | 2 | 40 | 5 | C |

In Examples 1 to 10, it is seen that the generation of streaky unevenness on the coating surface is suppressed, and thus the surface state of the coating surface was good. On the other hand, in Comparative Examples 1 to 3, it is seen that strong streaky unevenness is generated on the coating surface, and the surface state of the coating surface is poor.

According to the present invention, the applicator which applies the coating liquid onto the upper surface of the web and is capable of sufficiently enhancing the evenness of the coating surface can be obtained. In addition, by using the applicator of the present invention, the application method of evenly applying the coating liquid onto the upper surface of the web can be provided, resulting in high industrial applicability.

EXPLANATION OF REFERENCES

10: applicator

12: web

14: bar

16: barrier plate

16*a*: protrusion

16*b*: side portion of barrier plate coming into contact with coating liquid (side portion on downstream side)

16*c*: end portion on web side

16*d*: side portion on upstream side

17: supply tube

18: pump

20: support member

P: feed liquid storage portion

Q: liquid mass

What is claimed is:

1. An apparatus for coating comprising:

an applicator including a bar which rotates while coming into contact with an upper surface of a continuously travelling web via a coating liquid;

a barrier plate which is provided on an upstream side of the bar in a travelling direction of the web and allows the coating liquid to flow in a direction toward the web between the barrier plate and the bar; and a support member having an arc-shaped groove on the surface that comes into contact with the bar, having a structure that rotatably supports the bar, and which is provided with a distance to the barrier plate, wherein, when a distance between the barrier plate and an end edge portion of the bar, which is closest to the barrier plate, is referred to as A and a distance between the barrier plate and the web is referred to as B, A is 0.5 mm to 5 mm, B is 0.5 mm to 5 mm, and B≤A is satisfied.

2. The apparatus for coating according to claim 1, wherein a thickness of an end portion of the barrier plate on the web side is 0.5 mm or greater.

3. The apparatus for coating according to claim 1, wherein the barrier plate includes a protrusion on the web side.

4. The apparatus for coating according to claim 1, wherein the barrier plate is of a movable type.

5. The apparatus for coating according to claim 1, wherein the apparatus for coating is performed to allow a coating amount of the coating liquid applied onto the web to be 2 $ml/m^2$ to 50 $ml/m^2$.

6. The apparatus for coating according to claim 1, wherein a distance between the support member and the barrier plate is 0.1 mm to 20 mm.

* * * * *